US005312683A

United States Patent [19]

Chou et al.

[11] Patent Number: 5,312,683

[45] Date of Patent: May 17, 1994

[54] SOLVENT COATED METALLIC THERMAL MASS TRANSFER DONOR SHEETS

[75] Inventors: Hsin-hsin Chou, Woodbury; Christopher E. Kunze, Blaine; Peter A. Vono, Wyoming, all of Minn.

[73] Assignee: Minnesota Mining and Manufacturing Company, St. Paul, Minn.

[21] Appl. No.: 58,441

[22] Filed: May 7, 1993

[51] Int. Cl.[5] ..... B41M 5/26

[52] U.S. Cl. ..... 428/328; 156/234; 428/195; 428/207; 428/323; 428/333; 428/913; 428/914

[58] Field of Search ..... 427/146, 152, 372.2; 428/195, 206, 323, 328, 330, 913, 914, 207, 333; 156/234

[56] References Cited

U.S. PATENT DOCUMENTS

| | | | |
|---|---|---|---|
| 4,472,479 | 9/1984 | Hayes et al. | 428/324 |
| 4,627,997 | 12/1986 | Ide | 428/216 |
| 4,923,846 | 5/1990 | Kutsukake et al. | 503/227 |
| 4,990,486 | 2/1991 | Kamosaki et al. | 503/227 |
| 4,999,076 | 3/1991 | Incremona et al. | 427/152 |
| 5,141,915 | 8/1992 | Roenigk et al. | 503/227 |

FOREIGN PATENT DOCUMENTS

| | | | |
|---|---|---|---|
| 4014866A1 | 11/1990 | Fed. Rep. of Germany | 503/227 |
| 92-3805 | 5/1992 | Rep. of Korea | 503/227 |
| 8601291 | 5/1986 | Netherlands | 503/227 |
| WO91/14581 | 10/1991 | PCT Int'l Appl. | 503/227 |

OTHER PUBLICATIONS

WO/89/1604 Apr. 17, 1984 EPX (Abstract Only)(No Translation).

*Primary Examiner*—Pamela R. Schwartz

*Attorney, Agent, or Firm*—Gary L. Griswold; Walter N. Kirn; Mark A. Litman

[57] ABSTRACT

A thermal mass transfer donor element comprising a carrier layer having on one surface thereof a mass transferable layer of thermoplastic organic polymeric binder and metal flakes, said metal flakes having an average ratio of length to thickness of greater than 20:1.

25 Claims, No Drawings

SOLVENT COATED METALLIC THERMAL MASS TRANSFER DONOR SHEETS

BACKGROUND OF THE INVENTION

1. Field of the Invention

The present invention relates to thermal mass transfer donor elements and particularly to thermal mass transfer donor elements which provide a metallic appearing image upon thermal transfer.

2. Background of the Invention

Thermal mass transfer imaging processes are finding increasing application in the marketplace and provide environmentally sound, dry imaged processes. A thermal mass transfer donor sheet is placed in contact with a receptor sheet (which may be specifically designed for use in mass transfer or may be a conventional paper or film), the donor sheet is heated in an imagewise manner (usually from the backside) with localized heating effected by a thermal print head, irradiation through a mask or stencil, or coherent light imaged as with a laser or, light emitting diode, or solid state laser. The imagewise distribution of heat causes an imagewise transfer of material from a surface of the donor to the receptor which is in contact with that surface. The material which is transferred is usually a binder containing colorant (e.g., a dye, pigment, or both dye and pigment). The binder is a thermally softenable material which releases from a carrier layer on a carrier layer on the donor element and adheres and transfers to a receptor sheet.

Thermal mass transfer imaging, like most other forms of imaging, has traditionally used the primary additive and subtractive colors (and black) as the colorant in the donor transfer layers. In commercial situations it has become desirable to be able to provide additional colors beyond red, yellow, green, blue, cyan, and magenta (and black). Tailored colors, fluorescent colors, and metallic images are desirably available to the image maker.

Metal image forming impact printing elements have been disembeded with a vapor deposited metal film with a binder as a separate layer. U.S. Pat. No. 4,472,479 (Hayes et al.) describes an impact printing donor element which can provide a metallic appearing image which comprises a carrier layer and an impact transferable layer(s) containing metal particles or particles with metallic colors (e.g., mica flakes with coatings thereon). All working examples are of non-metal flakes with coatings thereon. A dye may also be present in the transferable layer(s) to improve the tone of the metal color.

A paper entitled "New Color Thermal Transfer Printing Media" presented to "The 5th International Congress on Advances in Non-Impact Printing Technologies" in San Diego, Calif., Nov. 12–17, 1989, described a thermal metallic transfer ribbon having an anchoring layer interposed between the vapor deposited metal and a release layer to secure the vapor deposited metal to the release layer.

U.S. Pat. No. 4,868,049 (Nelson) teaches a transfer sheet comprising, in successive layers, a carrier film, a metallic film, and an adhesive. Optionally, the transfer sheet further comprises, in successive layers, a release coat and a polymer coat interposed between the carrier film and the metallic film, and a primer coat interposed between the metallic film and adhesive. A preferred release coat is said to be made from an ethylene vinyl acetate copolymer.

U.S. Pat. No. 4,875,961 (Oike et al) discloses a heat-sensitive medium comprising a support, and a transfer layer comprising at least a non-flowable ink layer and an adhesive layer, said two layers being provided in that order from the support side. Optionally, a lubricant layer may be interposed between the ink layer and the support.

The metal-particulate containing mass transfer donor element such as that shown by Hayes et al. (U.S. Pat. No. 4,472,479) does not provide a high resolution, shiny metallic image. The films in which the metal layer is vapor deposited do not form high quality, high resolution imaging donors. To provide the most desirable thermal mass transfer metal appearing donor elements, it would be necessary to provide both a better reflecting (shinier) metal image and an image with greater resolution than that available from vapor deposited metallic donor layers.

BRIEF DESCRIPTION OF THE INVENTION

A metallic image thermal mass transfer donor element comprises a conventional thermal transfer carrier layer and at least one donor layer comprising a thermally softenable binder and metallic flakes. The use of flakes as opposed to conventional particles provides two distinct beneficial functions. The flakes tend to provide a flatter appearance to the metal image (providing more reflectance and a shinier appearance) and the flakes tend to separate in a better defined relationship to the imagewise pattern of thermal imaging since the flakes are already separate as compared to the areas of a continuously deposited metal film.

DETAILED DESCRIPTION OF THE INVENTION

A thermal mass transfer element which can provide a metal image upon thermal mass transfer comprises a carrier layer and at least one thermal mass transfer donor layer comprising a thermally softenable binder and metallic flakes. The flakes may be entirely within the binder layer, predominately on one surface of a binder layer, or both within and on the surface(s) of a binder layer.

The flakes used in the practice of the present invention are distinct from the metal particles which are believed to have been heretofore used in many transfer imaging systems. Rather than being of relatively uniform dimensions, the flakes necessary for use in the materials of the present invention have comparatively high (as compared to conventional particles) ratios of length to thickness. The ratio of length (whether average length, mean length, or other forms of defining a major dimension of a particulate) to thickness in particles normally may range from 1:1 to 10:1 or the like and be considered a normal distribution of particle. Flakes in the practice of the present invention have a minimum average ratio of length to thickness of at least 20:1 or at least 25:1, preferably 100:1, and more preferably 500:1 to obtain the benefits of the present invention. Ranges of 25:1 to 2000:1 are also acceptable, or 40:1 or 50:1 to 500:1 are preferred. They should likewise have a maximum average ratio of length to thickness of 2000:1 and more preferably 1000:1. By average ratio it is meant the number average of the ratios of the individual particles. The thickness of the flake is between 100Å to 1500Å, preferably between 200Å to 1000Å, more preferably between 250Å to 750Å and most preferably between 300Å to 500Å.

Any suitable metal may be used to form the flakes for use in the practice of the present invention. The coating compositions most conveniently used to make the metal flake containing donor layers of the present invention are commercially available or may be manufactured according to the teachings of U.S. Pat. No. 4,321,087. The process described in this patent can be used with substantially any metal, and the use of a solvent which is compatible with the release layer used in the process of that patent will not only provide a suspension of the particles, but also provide a coating solution of flakes, binder and solvent which can be coated onto a thermal transfer donor layer to form the thermal mass transfer donor elements of the present invention. If the process of the patent is used with a different binder (than that of the release coating) already dissolved in the solvent used to lift the film, the composition of the thermal transfer binder can be readily modified. Preferred metals are aluminum, gold, silver, titanium, brass, bronze, copper, iron, nickel, chrominium and zinc.

The support member for the donor article or receptor article may be any sheet material which is compatible with a process for making a composite article according to the present invention. Typically, the support member for the donor article is a ribbon. The support member may be rough or smooth, transparent or opaque, flexible or rigid, and porous or impervious. Materials which may be suitable as a support member include, for example, natural or synthetic polymeric resins (thermoplastic or thermoset), and ceramics (including glasses, metals, papers, and fabrics). Preferably, the support member is made of a polymeric resin including, for example, polyester, (e.g., polyethylene terephthalate), cellulose ester, polycarbonate, polyvinyl resin, (e.g., polyvinyl chloride, polyvinylidene chloride, polyvinyl butyral, polyvinyl formal), polyamide, polyimide, polyacrylate (e.g., copolymers and homopolymers of acrylic acid, methacrylic acid, n-butyl acrylate, and acrylic anhydride), and polyolefin. The support member may contain conventional fillers such as carbon black, titania, zinc oxide, dyes, colorants, and be treated or coated with those materials generally used in the formation of films such as coating aids, lubricants, antioxidants, ultraviolet radiation absorbers, surfactants, and catalysts. As such, the support member may comprise any number of layers required for coating aids, lubricants, antioxidants, ultraviolet radiation absorbers, surfactants, and catalysts.

A suitable support member for the donor article includes, for example, a polyethylene terephthalate (PET) sheet having a fluorene polyester polymer (FPE) consisting or consisting essentially of repeating, interpolymerized units derived from 9,9-bis-(4-hydroxyphenyl)fluorene and isophthalic acid, terephthalic acid, or mixtures thereof, wherein the polymer has a sufficiently low oligomer content to allow formation of a uniform film coated on the back surface thereof. For additional details on the PET sheet having FPE coated on the back surface thereof, see assignee's copending application having U.S. Ser. No. 07/603,800 (Hampl et al.), filed Oct. 26, 1990, the disclosure of which is incorporated herein by reference. Other carrier layers useful for the donor sheet comprise thin papers, non-woven layers, thin organic synthetic polymeric films, and the like of from 1 to 20 micrometers, preferably 3 to 15 micrometers, and more preferably 4 to 12 micrometers.

Preferably, the support member comprising the donor article is a 1 to 12 micrometer thick polyethylene terephthalate (PET) sheet. More preferably, the support member comprising the donor article is a polyethylene terephthalate sheet (5 to 8 micrometers) up to about 6 micrometers thick.

Sources of commercially available support members for the donor article include, for example, E. I. duPont de Nemour of Wilmington, Del.; Teijin of Japan, and Toray of Japan.

Selection of a receptor article is dependent on the construction of the donor article to be used with the receptor article. To facilitate adhesion of the transferred inorganic pigment to the receptor article, a thermoplastic material is present either as a coating over the inorganic pigment, or comprises the receptor article itself (i.e., the receptor article is a thermoplastic or has a thermoplastic material coated on the front surface thereof).

Suitable support members for the receptor article include, for example, a plastic sheet, a paper sheet, or a dye receptor (see, e.g., U.S. Pat. No. 4,853,365, Jongewaard et al., the disclosure of which is incorporated herein by reference). Sources of commercially available support members for the receptor article include, for example, E. I. duPont; Schoeller Technical Papers, Inc., of Pulaski, N.Y.; Dai Nippon of Japan, and Calcomp, a Sanders Company of Anaheim, Calif.

Metals useful as an inorganic pigment include, for example, transition metals, noble metals, and rare earth metals. Such metals include metals selected from the elements of atomic numbers 11–106. More important metals in order of atomic number are: aluminum, scandium, titanium, vanadium, chromium, manganese, iron, cobalt, nickel, copper, zinc, gallium, germanium, yttrium, zirconium, niobium, molybdenum, ruthenium, rhodium, palladium, silver, cadmium, indium, tin, antimony, lanthanum, gadolinium, hafnium, tantalum, tungsten, rhenium, osmium, iridium, platinum, gold, thallium, and lead. The most preferred metals, all of which are non-ferromagnetic, are aluminum, copper, gold, iridium, palladium, platinum, rhodium, silver, rhenium, ruthenium, osmium, indium, tin, and lead. Only metals having obvious undesirable properties (e.g., radioactivity or liquidity at room temperatures would be obviously undesirable.

The binder material used with the metal flakes in the donor materials of the present invention may be substantially any solvent soluble or dispersible thermoplastic organic binder. Organic solvent soluble thermoplastic polymeric resins, particularly synthetic resins, are preferred in the practice of the present invention. These binders include most, if not all, classes of thermoplastic polymers such as synthetic cellulosics (e.g., nitrocellulose, cellulose acetate butyrate), polyvinyl resins (e.g., polyvinyl acetals such as polyvinyl butyral, polyvinyl chloride and its copolymers), polyolefins, polyesters, polyacrylics, and the like.

Dyes or color pigments may be used in the flakelayer or in contemporaneously transferred binder layers to improve the tone or adjust the tone of the metal image. Any dye or pigment which can be dispersed or dissolved in a thermoplastic binder layer can be used for this purpose. The binder normally comprises from at least 10% by weight up to 95% by weight of the total weight of binder and flakes in the thermal transfer donor layer(s). In a single donor layer construction, the binder preferably comprises from 5 to 70% by weight of the total weight of binder and metal flakes.

Additional layers may also be present on the donor element. The backside of the donor element may have a non-stick coating, and the side of the carrier layer on which the mass transfer donor layer(s) are present may have a release layer between the carrier and the mass transfer layer(s), or a cotransferable layer may be on the surface of the mass transfer layer.

These and other aspects of the present invention will be seen in the following non-limiting examples.

EXAMPLES

Example 1

Single Layer Silver Color

A solution of 3% Metasheen Silver MSP 1391 was made in ethanol. This solution was coated onto 6 micrometers PET using a #10 Meyer Bar to give an approximate 0.5μ dry coating thickness. This film was then printed, using the Model H printer, onto 3 different receptors: 3 mil PVDC primed PET, Dai Nippon Type I receptor, and 3M Desktop Color Transparency (4.0 mil). Transfer was good (>200 dpi) between 14 and 18 volts (1.86 $J/cm_2$ to 3.08 $J/cm_2$).

Example 2

Other Single Layer Metallic Color

To make other single layer metallic colors, the following were mixed together for each color:

| Color | Ratio | Contents |
|---|---|---|
| Metallic Red | 1.0/1.0 | Metasheen Silver MSP 1391/RH* Red 50-4804 |
| Metallic Blue | 1.0/1.0 | Metasheen Silver MSP 139 I/RH Blue 50-4809 |
| Metallic Green | 1.0/0.5/0.5 | Metasheen Silver MSP 139 1/RH Blue 50-4809/RGH Yellow 50-4803 |
| Metallic Purple | 1.0/0.5/0.5 | Metasheen Silver MSP 1391/RH Red 50-4804/RGH Blue 50-4809 |
| Gold | 1.0/0.9/0.1 | Metasheen Silver MSP 1391/RH Yellow 50-4803/RH Red 50-4804 |

Each of the above solutions were 3% solids in ethanol and were coated out using a #10 Meyer Bar onto 6μ PET for approximate 0.5μ dry coating thickness. They were then printed onto Dai Nippon Type I receptor and 3M Rainbow TM Desktop Color Transparency (4.0 mil). Resolution was again good (>200 dpi) between 14 and 18 volts (1.86 $J/cm^2$ to 3.08 $J/cm^2$).

None of the single layer metallic color thermal mass transfer to dye receptors is completely clean. Some residuals of aluminum flakes and pigments were left on the donors. As a result, the rough texture on the surface of the transferred metallic image made it appear to have slightly different color tone.

Example 3

To overcome the difficulty of incomplete transfer in the first two examples, the formulations have been modified such that complete transfer of new single layer metallic colors to a 3M Rainbow TM transparency become possible. The following were mixed together in ethanol for each color:

| Color | Ratio/ concentration/ Coating bar | Contents |
|---|---|---|
| Metallic Gold | A/B = 5/1, 5%, #6 Meyer bar | A = RBH pigment yellow/ B76/Staybelite ester 10 7/4/1 B = Metasheen Silver |
| Metallic Gold | A/B = 1/1, 3%, #10 Meyer bar | A = RBH yellow 4934/B76/ Staybelite ester 10 7/2/1 B = Metasheen Silver |
| Metallic Silver | A/B = 1/5, 3%, #10 Meyer bar | A = EHEC X-high B76/ Staybellite ester 10 7/2/1 B - Metasheen Silver |

Each of the above solutions were coated onto 6μ PET for an approximate 0.5μ dry coating thickness. They were then printed onto 3M Rainbow TM transparency (4.0 mil). Resolution was again good (>200 dpi) between 15–19 volts (2.15–3.45 $J/cm^2$). All the transferred images appeared complete. No residuals were left on the donors.

Example 4

Double layer coating; a dye receptive undercoat layer for composite metallic colors.

Two solutions were made for this application. The first solution was a transferrable dye receptive layer consisting of 0.5/1/8 Elvax 210/(1/1 TS610/B99)/Wax Emulsion at 6.4% in toluene. This solution was coated out using a #8 Meyer Bar onto 6μ PET to give an approximate 0.9μ dry coating thickness. This coat was oven dried at approximately 80° C. for one minute. Then a solution of 3% Metasheen Silver MSP 1391 in ethanol was coated onto 6μ PET using a #10 Meyer Bar to give an approximate 0.5μ dry coating thickness. Thus, the total thickness of both of the layers was approximately 1.4μ. This was then printed onto Dai Nippon Type I receptor and 3M Rainbow TM Desktop Color Transparency (4.0 mil). Resolution was again good (>200 dpi) between 14 and 18 volts (1.86 $J/cm^2$ to 3.08 $J/cm^2$) with a more complete transfer at these energies. It was then possible to transfer a dye on top of these two layers at a resolution >200 dpi. The ROD of the dye transfer of cyan was 1.05.

Example 5

A dye receptive metallic coating the same as example 4 was prepared on a 4.5 micrometer PET film with antistick backcoat. Before printing, the film patch was properly spliced on a regular YMCK ribbon between the K patch and the Y patch. A proper prompt mark to initiate printing was placed at the beginning of the spliced film patch.

A regular black and white image called "ballons" was imported into Photoshop software program using a Macintosh computer. The image was artificially converted from black and white to CMYK and the channels were split. 4 individual images designated "ballons Y", "ballons M", "ballons C" and "ballons K" that are exactly the same were generated. "ballons M, C, K" were modified using the tools of the Photoshop program in order to make the final printed image color instead of B&W. Those YMCK images were then opened as RAW image files in Photoshop and merged under "Mode" menu into a single composited YMCK file. The image was saved as a CMYK Photoshop image file with a 300 dpi resolution.

After the proper receptor and the spliced donor ribbon were properly placed in the Rainbow printer, the image was opened in the 3M Rainbow Color Proofer software program, RIP processed and printed. With the spliced patch being printed as Y-separation, Y-patch as M-separation, M-patch as C-separation and C-patch as K-separation, a composited metallic colored image was created. The image had a resolution of 300 dpi and appeared to be metallic of various colors.

Example 6

Double layer metallic color, a transparent/translucent undercoat layer serving as a release/protective coating.

A dispersion of 10% solid TS610 Hydrophobic $SiO_2$(Cabot)/Acryloid B99 (Rohm & Haas), 1/1 in toluene, was prepared and was coated onto 6μ PET using a #10 Meyer Bar to give an approximate 0.5μ dry coating thickness. This was used as a controlled release layer.

Another solution of 5% Metasheen Silver MSP 1391 was made in ethanol. This solution was then coated onto the controlled release coating using a #10 Meyer Bar to give an approximate 0.5μ dry coating thickness. This film was then printed, using the Model II printer, onto 3 different receptors: Dai Nippon Type I receptor, 3M Rainbow# Desktop Color Transparency (4.0 mil), and Scotchcal film. Complete transfer of both the metallic and the release coatings was obtained with high resolution (>200 dpi) between 14 and 18 volts (1.86 $J/cm^2$ to 3.08 $J/cm^2$).

Example 7

Double layer metallic coating; an adhesive overcoat for transferring to both thermoplastic and nonthermoplastic receptors, e.g. printing paper, plain paper, and a PET intermediate carrier (for image retransfer to Scotchprint for exotic color add-on).

Two solutions were made for this application. The first was a solution of 3% Metasheen Silver MSP 1391 in ethanol. It was coated onto 6μ PET using a #10 Meyer bar to give an approximate 0.5μ dry coating thickness. Then an adhesive solution consisting of Elvacite 2014/TS610/B99 (1/1)/Wax Emulsion (1.5/1/4) at 6% in toluene was coated on top of the metallic layer with a #20 Meyer Bar. This gave an approximate 2μ dry coating thickness. This coat was oven dried at approximately 80° C. for one minute. Thus, the total thickness of both of the layers was approximately 2.5μ. This was then direct-printed onto Scotchcal film receptor and Calcomp thermal paper using the GRL Model III printer. Resolution was again good (>200 dpi) at 12 volts (11.8 $J/cm^2$). By using a similar formulation for an adhesive layer, Elvacite 2014/TS610/B99(1/1)/wax emulsion (1.5/2/4), and coating it out at an approximate thickness of 6.5μ (10% in toluene, #40 Meyer Bar) over the silver layer, direct-print to plain paper was also obtained with good resolution.

In another experiment, a monochrome 3M image was chosen for mass transferring the metallic image. A 1 mil plain PET substrate was used as the intermediate carrier. The metallic image was transferred at V(−11.8$J/cm^2$) onto the PET film. In actual printing, the electronic image has to be converted to its mirror image before sending to the printer.

The heat and pressure transfer to a Scotchcal film was carried out at 300° F. using a 3M Model 1147 film laminator used in Matchprint application. A complete, high quality metallic image was obtained on the Scotchcal receptor. This mode of imaging can be more easily incorporated into the current Scotchprint TM applications than the direct print.

Example 8

Triple layer coating; an adhesive overcoat and a dye receptive undercoat for metallic image re-transfer to printing paper.

In addition to the two solutions used in example 7, a 6% solid Wax Emulsion solution was prepared. The donor sample was prepared by first coating a 9.5% solution containing Elvacite 2014/TS610/B99 (1/1)/wax emulsion (1.5/1/4) on the 6μPET substrate using a #20 Meyer Bar. This was followed by the Metasheen Silver MSP 1391 coating (3% in ethanol, #10 Meyer Bar). Finally, the Wax Emulsion solution (6% in toluene, #5 Meyer Bar) was coated as the adhesive layer. The donor film was used to transfer an image to a 1 mil PET film. The image was then completely heat-and-pressure retransferred to a Calcomp paper as in Example 7.

Example 9

Continuous Single Layer Silver

A solution of 3% Metasheen Silver MSP 1391 was made in Ethanol. This solution was continuously coated up to 500 ft. onto Toray TTR101 4.5 micron with an antistick backcoat. Dry thickness of the coating was measured to be 0.5 microns on a Laserule Thickness Gauge. This coating was then Thermally Printed onto 3M Desktop Color Transparency (4.0 mil) using the 3M Rainbow TM Desktop Color Proofer. The metallic ribbon was registration marked as a "yellow" section of a 4 color Dye ribbon, and a test pattern was drawn in Adobe Photoshop TM using the Yellow separation Burn Profile. Resolution was >200 dpi and the transfer began at 30% and continued up to 100% of the energy profile (~1.8–6 $J/cm^2$). The transfer of the metal layer was not complete and a residual layer of metallic coating was left on the Donor Ribbon.

Example 10

Continuous Double Layer Silver Coating

A dispersion of 6% solids TS610 Hydrophobic $SiO_2$ (Cabot)/Acryloid B99 (Rohm/Haas) at 1/9 in Toluene was prepared and was continuously coated up to 500 ft. onto Toray TTR101 4.5 micron with an antistick backcoat. Dry thickness of the coating was measured to be 0.75 microns on a Laserule Thickness Gauge. This layer was then overcoated with a 3% Specular Silver MSP 1332 Solution and the total coating thickness was measured at 1.3 microns. This coating was then Thermally Printed onto 3M Desktop Color Transparency (4.0 mil) using the 3M Rainbow TM Desktop Color Proofer. The metallic ribbon was registration marked as a "yellow" section of a 4 color Dye ribbon, and a test pattern was drawn in Adobe Photoshop TM using the Yellow Separation Burn Profile. Resolution was >200 dpi and the transfer began at 30% and continued up to 100% of the energy profile (~1.8–6 $j/cm^2$). The transfer of the metal layer was complete and no metal was left on the Donor Ribbon.

Example 11

Continuous Double Layer Gold Coating

A dispersion of 6% solids TS610 Hydrophobic $SiO_2$ (Cabot)/Acryloid B99 (Rohm/Haas) at 1/9 in Toluene was prepared and was continuously coated up to 500 ft. onto Toray TTR101 4.5 micron with an antistick backcoat. Dry thickness of the coating was measured to be 0.75 microns on a Laserule Thickness Gauge. This layer was then overcoated with a 3% Metallic Gold solution consisting of Specular Silver MSP 1332/RGH Yellow 50-803/RGH Red 50-4804 (1.0/0.9/0.1) and the total coating thickness was measured at 1.5 microns. This coating was then Thermally Printed onto 3M Rainbow TM Desktop Color Transparency (4.0 mil) using the 3M Rainbow TM Desktop Color Proofer. The metallic ribbon was registration marked as a "yellow" section of a 4 color Dye ribbon, and a test pattern was drawn in Adobe Photoshop TM using the Yellow Separation Burn Profile. Resolution was >200 dpi and the transfer began at 40% and continued up to 100% of the energy profile (~2.4–6 J/cm$^2$). The transfer of the metal layer was complete and no metal was left on the Donor Ribbon. The materials used in the above examples are commercially available. For example, some of those materials are available from the following list of sources:

MATERIALS AND VENDORS

| Material | Vendor |
|---|---|
| RBH pigments | RBH Dispersions, INC. (Bound Brook, NJ) |
| Metasheen Silver Ink | Alford Packaging (Carlstadt, NJ) |
| TS610 hydrophobic $SiO_2$ | Cabot Co. (Tuscola, IL) |
| Acryloid B82, B99 | Rohm & Haas (Philadelphia, PA) |
| Elvacite 2014, 2044 | E. I. DuPont (Wilmington, DE) |
| $Al(OH)_3$, Alcoa SpaceRite S-11 Alumina | ALCOA (Bauxite, AR) |
| Zirconium Hex-cem | Mooney Chemical, Inc. (Cleveland, OH) |
| Elvax 210 | E. I. DuPont (Wilmington, DE) |
| Staybelite Ester 10 and EHEX X-high (ethyl cellulose) | Herculus Inc. (Wilmington, DE) |
| Chlorowax 70 | Diamond Shamrock (Cleveland, OH) |
| Shellwax 700 | Shell Chemical Co. (Houston, TX) |
| Carnauba wax | Frank B. Ross Co. (Jersey City, NJ) |
| Synthetic Candelilla wax | Frank B. Ross Co. (Jersey City, NJ) |
| Carboset XL-11 | B. F. Goodrich (Cleveland, OH) |

The Wax Emulsion used in the examples is a 5% solid wax-polymer emulsion in Toluene was prepared as following. First, a clear, 5% solid solution of the wax-polymer with the ingredients; Chlorowax 70/Shellwax 700/Acryloid B82/Carnauba was/Synthetic Candelilla/Staybelite Ester 10/Elvax 210, 1.25/1.67/0.1/2.5/1.0/0.05/0.6, was prepared at an elevated temperature of ~70° C. Then a small amount (2–5% to the solid content of the solution) of charging agent, Zirconium Hex-Cem was added to the solution. The solution was then brought back to room temperature (preferably under high speed agitation) and a stable emulsion was obtained.

What is claimed:

1. A thermal mass transfer donor element comprising a carrier layer having on one surface thereof a mass transferable layer of thermoplastic organic polymeric binder and metal flakes, said metal flakes having an average ratio of length to thickness of greater than 20:1.

2. The element of claim 1 wherein said carrier layer comprises a sheet of 1 to 12 micrometers in thickness.

3. The element of claim 2 wherein the average ratio of length to thickness for said flakes is between 40:1 and 500:1 and said sheet comprises an organic synthetic polymer.

4. The element of claim 3 wherein said binder is an organic, synthetic, solvent soluble or dispersible polymeric resin.

5. The element of claim 4 wherein the weight percent of binder to the total weight of binder and metal flakes on said one surface is between 10% and 90%.

6. The element of claim 2 wherein said binder comprises an organic, synthetic, polymeric thermoplastic, solvent soluble or dispersible resin.

7. The element of claim 6 wherein a release layer is present between said carrier layer and said mass transferable layer.

8. The element of claim 2 wherein a release layer is present between said carrier layer and said mass transferable layer.

9. The element of claim 1 wherein the average ratio of length to thickness of said flakes is between 25:1 and 2000:1.

10. The element of claim 1 wherein the average ratio of length to thickness of said flakes is 40:1 to 500:1.

11. The element of claim 1 wherein the average ratio of length to thickness of said flakes is 50:1 to 500:1.

12. The element of claim 1 wherein said binder is an organic, synthetic polymeric, solvent soluble or dispersible binder.

13. The element of claim 1 wherein a release layer is present between said carrier layer and said mass transferable layer.

14. The element of claim 1 in which the thickness of the metal flakes is from 100 angstroms to 1500 angstroms.

15. A process for forming a thermal mass transfer donor element which can provide a metal image comprising the steps of:

a) providing a coating solution comprising a solvent, metal flakes having an average ratio of length to thickness of at least 20:1, and a thermoplastic binder, b) coating said solution onto one surface of a carrier layer, and c) drying said solution to form a layer of metal flakes and binder.

16. The process of claim 15 wherein said flakes have an average ratio of length to thickness of between 25:1 to 2000:1.

17. The process of claim 16 wherein the binder is present on said surface in comparison to the total weight of binder and flakes in said solution in an amount between 10% and 90%.

18. The process of claim 17 wherein said binder comprises an organic, synthetic, solvent soluble or dispersible, thermoplastic polymer.

19. A thermal mass transfer donor element comprising a carrier layer having one surface in continuous contact with a thermal mass transferable layer, and at least one thermal mass transferable layer over said one surface comprising metal flakes, having an average ratio of length to thickness of greater than 20:1, in a thermoplastic organic polymeric binder.

20. The element of claim 19 further comprising a continuous adhesive top layer on the same side of the carrier as the thermal mass transfer layer.

21. A thermal mass transfer donor element comprising a carrier layer having on one surface thereof in continuous contact with said surface, a material consisting essentially of a thermal mass transferable layer comprising a thermoplastic organic polymeric binder and metal flakes, said metal flakes having an average ratio of length to thickness of greater than 20:1.

22. The element of claim 21 in which the thermal mass transferable layer comprises 5 to 70% by weight binder based on total weight of binder and metal flakes.

23. A thermal mass transfer donor element consisting of a carrier layer having on one surface thereof in continuous contact with said surface, a thermal mass transferable layer comprising a thermoplastic organic polymeric binder and metal flakes, said metal flakes having an average ratio of length to thickness of greater than 20:1, and having on the opposite surface thereof a backside non-stick coating.

24. A thermal mass transfer donor element consisting of at least one thermal mass transferable layer, which comprises metal flakes, having an average ratio of length to thickness of greater than 20:1, in a thermoplastic organic polymeric binder; a carrier layer; and a release layer which is interposed between the carrier layer and a thermal mass transferable layer and which is in continuous contact with the carrier layer and said thermal mass transferable layer.

25. A method for producing a metallic image comprising:

contacting a receptor with a thermal mass transfer donor element which comprises a carrier layer, having one surface in continuous contact with a thermal mass transferable layer, and at least one thermal mass transferable layer comprising metal flakes, having an average ratio of length to thickness of greater than 20:1, in a thermoplastic organic polymeric binder, said contact being such that a thermal mass transferable layer touches the receptor;

heating the donor sheet in an imagewise manner thereby transferring metal flakes and organic polymeric binder in an imagewise manner to said receptor; and separating said receptor and mass transfer donor element.

* * * * *

UNITED STATES PATENT AND TRADEMARK OFFICE

CERTIFICATE OF CORRECTION

PATENT NO. : 5,312,683

DATED : May 17, 1994

INVENTOR(S) : Chou et al.

It is certified that error appears in the above-indentified patent and that said Letters Patent is hereby corrected as shown below:

Column 9, line 7, delete "50-803"
and insert --50-4803--.

Signed and Sealed this

Eighteenth Day of October, 1994

Bruce Lehman

*Attest:*

BRUCE LEHMAN

*Attesting Officer*

*Commissioner of Patents and Trademarks*